US011946660B2

(12) United States Patent
Grefsheim et al.

(10) Patent No.: US 11,946,660 B2
(45) Date of Patent: Apr. 2, 2024

(54) SYSTEM AND METHOD USING CONNECTED DAMPERS FOR DEHUMIDIFYING AIR

(71) Applicant: RESEARCH PRODUCTS CORPORATION, Madison, WI (US)

(72) Inventors: Scott Grefsheim, Madison, WI (US); Jeff Norton, Madison, WI (US); Tom Friederick, Madison, WI (US)

(73) Assignee: Research Products Corporation, Madison, WI (US)

( * ) Notice: Subject to any disclaimer, the term of this patent is extended or adjusted under 35 U.S.C. 154(b) by 281 days.

(21) Appl. No.: 17/188,035

(22) Filed: Mar. 1, 2021

(65) Prior Publication Data

US 2022/0090807 A1 Mar. 24, 2022

Related U.S. Application Data

(60) Provisional application No. 63/081,400, filed on Sep. 22, 2020.

(51) Int. Cl.
*F24F 13/10* (2006.01)
*F24F 7/06* (2006.01)
(Continued)

(52) U.S. Cl.
CPC ..... *F24F 11/30* (2018.01); *F24F 7/10* (2013.01); *F24F 13/0236* (2013.01); *F24F 13/10* (2013.01); *F24F 13/1486* (2013.01); *F24F 1/0038* (2019.02); *F24F 7/06* (2013.01); *F24F 2011/0002* (2013.01); *F24F 2013/221* (2013.01); *F24F 2110/12* (2018.01);
(Continued)

(58) Field of Classification Search
CPC ..... F24F 3/1405; F24F 7/00; F24F 1/0001; F24F 13/0236; F24F 13/10; F24F 2011/0002; F24F 13/14866; F24F 2013/221; Y10S 165/91
USPC ..... 165/230
See application file for complete search history.

(56) References Cited

U.S. PATENT DOCUMENTS 4,164,976 A 8/1979 Timmerman
6,427,461 B1 * 8/2002 Whinery ..... F24F 11/81 62/176.6

(Continued)

FOREIGN PATENT DOCUMENTS

KR 101634168 B1 6/2016

*Primary Examiner* — Jerry-Daryl Fletcher
*Assistant Examiner* — Daniel C Comings
(74) *Attorney, Agent, or Firm* — Foley & Lardner LLP

(57) ABSTRACT

A method of controlling indoor air humidity includes determining a dew point set point and determining a dew point of air from a space within a building. The method also includes, in response to determining that the dew point satisfies the dew point set point, determining a vent air dew point of air in an external environment surrounding the building. The method further includes, in response to determining that the vent air dew point is below the dew point set point by a dew point threshold, controlling a connecting member of a damper assembly to position a first damper of the damper assembly in an open position to draw in vent air from the external environment into the space, and to position a second damper of the damper assembly in a close position to substantially prevent recirculation of air through the dehumidifier.

18 Claims, 7 Drawing Sheets

(51) Int. Cl.

| | |
|---|---|
| ***F24F 7/10*** | (2006.01) |
| ***F24F 11/30*** | (2018.01) |
| ***F24F 13/02*** | (2006.01) |
| ***F24F 13/14*** | (2006.01) |
| *F24F 1/0038* | (2019.01) |
| *F24F 11/00* | (2018.01) |
| *F24F 13/22* | (2006.01) |
| *F24F 110/12* | (2018.01) |
| *F24F 110/20* | (2018.01) |
| *F24F 110/22* | (2018.01) |
| *F24F 110/40* | (2018.01) |

(52) U.S. Cl.
CPC ..... *F24F 2110/20* (2018.01); *F24F 2110/22* (2018.01); *F24F 2110/40* (2018.01); *Y10T 137/87467* (2015.04)

(56) References Cited

U.S. PATENT DOCUMENTS

| | | | | |
|---|---|---|---|---|
| 10,962,241 | B2 | 3/2021 | Poerschke et al. | |
| 11,413,927 | B2 | 8/2022 | Kullen et al. | |
| 2011/0168793 | A1* | 7/2011 | Kreft | F24F 3/14 236/44 C |
| 2015/0032264 | A1* | 1/2015 | Emmons | F24F 11/0001 700/276 |
| 2020/0338949 | A1* | 10/2020 | Kullen | B60H 1/00042 |

* cited by examiner

SYSTEM AND METHOD USING CONNECTED DAMPERS FOR DEHUMIDIFYING AIR

CROSS-REFERENCE TO RELATED PATENT APPLICATIONS

The present application claims the benefit of and priority to U.S. Provisional Patent Application No. 63/081,400, filed Sep. 22, 2020, which is hereby incorporated by reference in its entirety.

BACKGROUND

The present disclosure relates generally to controlling indoor air quality. More specifically, the present disclosure relates to systems and methods for managing indoor air ventilation and dehumidification.

SUMMARY

One embodiment of the disclosure is a manifold assembly. The manifold assembly includes a body and a damper assembly. The body defines a first opening, a second opening, a third opening, and a fluid plenum. The fluid plenum fluidly couples the first opening, the second opening, and the third opening. The damper assembly includes a first damper, a second damper, and a connecting member. The first damper is disposed within the fluid plenum proximate to the first opening. The second damper is disposed within the fluid plenum proximate to the second opening. The connecting member is coupled to both the first damper and the second damper and is configured to move the first damper and the second damper to selectively open one of the first opening and the second opening.

Another embodiment of the present disclosure is a dehumidifier assembly. The dehumidifier assembly includes a manifold, a damper assembly, and a dehumidifier. The manifold defines a first opening, a second opening, and a third opening. The damper assembly is coupled to the manifold. The damper assembly includes a first damper, a second damper, and a connecting member. The first damper is disposed proximate to the first opening. The second damper is disposed proximate to the second opening. The connecting member is coupled to both the first damper and the second damper and is configured to move the first damper and the second damper to selectively open one of the first opening and the second opening.

Yet another embodiment of the present disclosure is a method. The method includes receiving a relative humidity set point and a measured relative humidity of conditioned air within a building; controlling a dehumidifier assembly to modify the measured relative humidity based on the relative humidity set point; determining a dew point of the conditioned air; and controlling the dehumidifier assembly to modify a dew point of ventilation air entering the building based on the dew point of the conditioned air.

Yet another embodiment of the present disclosure is a method. The method includes determining a dew point set point and determining a dew point of air from a space within a building. The method also includes, in response to determining that the dew point satisfies the dew point set point, determining a vent air dew point of air in an external environment surrounding the building. The method further includes, in response to determining that the vent air dew point is below the dew point set point by a dew point threshold, controlling a connecting member of a damper assembly to position a first damper of the damper assembly in an open position to draw in vent air from the external environment into the space, and to position a second damper of the damper assembly in a close position to substantially prevent recirculation of air through the dehumidifier.

Yet another embodiment of the present disclosure is a control system. The control system includes a sensor configured to measure a dew point of air, a dehumidifier assembly, and a damper assembly that is fluidly coupled to the dehumidifier assembly. The damper assembly includes a first damper that controls an exchange of air with an external environment surrounding the building, a second damper that controls a recirculation of air from a space within the building, and a connecting member coupled to both the first damper and the second damper and configured to move the first damper and the second damper. The control system also includes a controller that is communicably coupled to the sensor, the dehumidifier assembly, and the damper assembly. The controller is configured to (i) receive a dew point set point; (ii) determine the dew point from the sensor; (iii) in response to determining that the dew point satisfies the dew point set point, determine a vent air dew point of air in the external environment surrounding the building; and (iv) in response to determining that the vent air dew point is below the dew point set point by a dew point threshold, controlling the connecting member to position the first damper in an open position, and to position the second damper of the damper assembly in a closed position.

Yet another embodiment of the present disclosure is an apparatus. The apparatus includes a humidity control unit comprising a memory storing machine readable instructions and a processor. The machine readable instructions are configured to cause the processor to perform operations including: (i) determining a dew point set point; (ii) determining a dew point of air from a space within a building; (iii) in response to determining that the dew point satisfies the dew point set point, determining a vent air dew point of air in an external environment surrounding the building; and (iv) in response to determining that the vent air dew point is below the dew point set point by a dew point threshold, controlling a connecting member of a damper assembly to position a first damper of the damper assembly in an open position to draw in vent air from the external environment into the space, and to position a second damper of the damper assembly in a closed position to substantially prevent recirculation of air through a dehumidifier.

DETAILED DESCRIPTION

Figure 1:
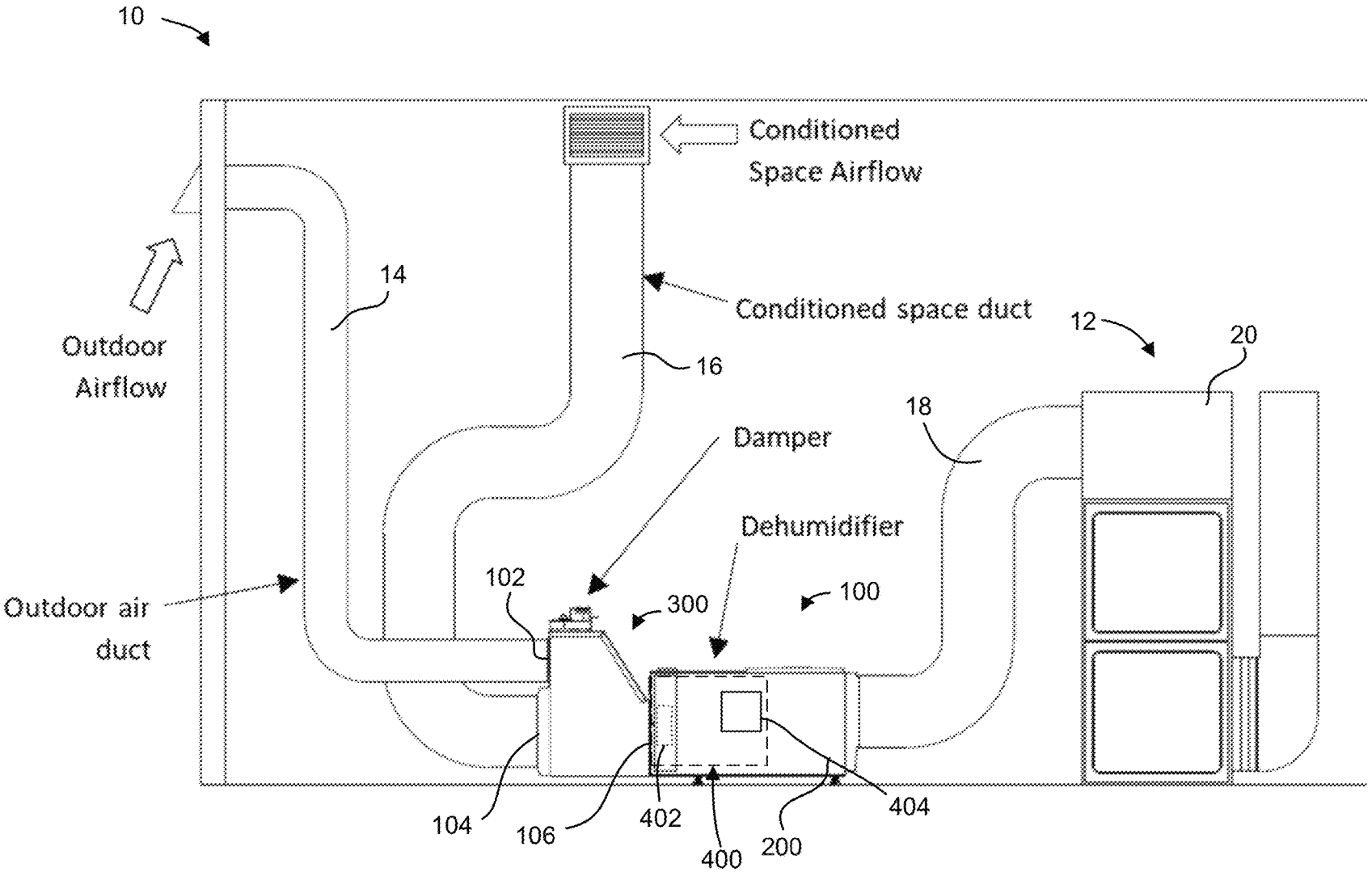
FIG. 1 is a schematic diagram of a whole-building dehumidification system, according to an embodiment.

Many buildings include dehumidification systems, which reduce and maintain the level of humidity in the air within the building, to improve comfort and/or to prevent the growth of mold and mildew. Dehumidification systems generally include a dehumidifier, which draws moist/humid air over a refrigerated evaporator coil to reduce the moisture content (e.g., absolute humidity) of the air. Water within the air condenses onto the evaporator coil and is directed away from the air stream. After passing across the coil, the dry, conditioned air is released into the building.

To maintain the desired level of comfort (e.g., relative humidity) within a building, the conditioned air is periodically recirculated through the dehumidification system. The dehumidification system is controlled based on measured relative humidity within the building, at a location that is physically separated from the HVAC system (e.g., in a room of the building, etc.). In other words, the dehumidification system requires a separate, external dehumidification control input to operate and maintain the desired relative humidity within the building. For example, the relative humidity may be monitored by a thermostat located in a common area or room of the building, and adjusted based on a relative humidity set point that is input to the thermostat by a user. Among other humidity metrics, users are most familiar with relative humidity and the value of relative humidity that is most comfortable to them. When the relative humidity falls outside of the desired range, the HVAC controller (e.g., a thermostat) activates and recirculates air through the dehumidifier.

As used herein, the term "relative humidity" refers to a ratio of the actual amount of water vapor in the air divided by the maximum amount of water vapor that the air can hold (e.g., percent relative humidity (RH %)). Because the maximum amount of water vapor that the air can hold varies with temperature, the absolute humidity (i.e., the actual amount of water vapor in the air) between an indoor and an outdoor environment may differ even if the relative humidity of both environments is the same. In other words, the relative humidity is not a measure of the absolute amount of water vapor in the air.

In some instances, the dehumidification system is connected to a vent (or ventilation) line to receive fresh air from an outdoor environment in addition to the recirculated, conditioned air. The vent line may include a normally closed control valve (e.g., damper, etc.) to control the flow of ventilation air into the building. When fresh air ventilation is desired, the control valve opens and allows fresh air to mix with the conditioned air from the return line. This structure improves indoor air quality by diluting polluted and/or stale indoor air and also pressurizes the building to help keep pollutants out of the building. However, because the dehumidification system is controlled based on the relative humidity (e.g., the relative humidity set point), this control scheme can cause large fluctuations in the moisture levels within the home during ventilation (e.g., the difference in temperature between the ventilation air and the conditioned air can mask the true moisture level of the incoming outdoor air). Additionally, because the return line is always open, the flow rate of ventilation air into the building is typically limited by the relative pressure drop across the vent line and the return line (e.g., the relative diameters of the lines/ducts, the relative length of the ducts, etc.), which increases the amount of power needed to draw in fresh ventilation air from the outdoor environment.

In general, disclosed herein are systems and methods for managing indoor air ventilation and humidity. In one embodiment, the system includes an inlet manifold of a dehumidifier assembly. The inlet manifold includes separate inlets for each of the vent line and the return line. The inlet manifold also includes a damper assembly that is structured to control the flow of air through both of the inlets simultaneously (e.g., via a single actuator). In one embodiment, the damper assembly includes a plurality of damper blades (e.g., valves, plates, etc.), each paired with a respective one of the inlets and positioned to control the flow of air through the inlets. The damper assembly also includes a connecting member coupled to the damper blades. The damper assembly is configured to coordinate movement of the damper blades so that the damper blade for vent line is fully open when the damper blade for the dehumidifier return line is fully closed. By selectively restricting the flow of conditioned air through the return line, a larger amount of ventilation air can be introduced into the system. Additionally, because each of the damper blades is coupled to a single connecting member, there is no change in the number of actuators that are required to control the flow of air through the vent line. Moreover, isolating the vent line from the return line allows for independent measurement and control of absolute moisture levels in the ventilation air, which is a primary contributor to the overall moisture load in the building.

In one embodiment, the system includes a control system for monitoring the condition of air entering the dehumidifier assembly, at an inlet of the dehumidifier, before the air is discharged into the building (e.g., immediately downstream of the inlets, at an outlet of the inlet manifold to the dehumidifier, between coils of the dehumidifier, etc.). The control system is configured to control the dehumidifier assembly using different humidity metrics depending on whether the dehumidifier assembly is recirculating conditioned air through the building or ventilating the building. When recirculating conditioned air (e.g., via the return line) the control system is configured to control the dehumidifier assembly based on a user-specified relative humidity value (e.g., a relative humidity set point). When ventilating the building (e.g., via the vent line), the control system is configured to control the dehumidifier assembly based on an absolute humidity metric such as the dew point (e.g., a dew point set point). In one embodiment, the control system is configured to convert the relative humidity value to a dew point value, and to use the dew point value when modifying the moisture level of the ventilation air. Among other benefits, this control approach reduces fluctuations in the absolute humidity of the air within the building that may be caused when ventilating the building. This control approach eliminates the need for a user to adjust the dew point setting directly, and instead utilizes traditional environmental inputs (e.g., the RH % and temperature) that are familiar to most users.

FIG. 1 shows a whole-building dehumidification system 10, according to an embodiment. The system 10 may be installed in a residential home, a commercial property, or another building or structure. The system 10 includes an air handling unit 12 and a dehumidifier assembly 100 that together form part of a building's heating, ventilation, and air conditioning (HVAC) system. The air handling unit 12 is configured to control and direct the flow of air through the HVAC system. The air handling unit 12 may include fans, blowers, or other fluid drivers to control the flow of air through the air handling unit 12 and/or dehumidifier assembly 100. In one embodiment, the air handling unit 12 is part of a furnace or air cooling unit that is used to heat or cool incoming air and to provide the conditioned air to various rooms and/or zones (e.g., levels, spaces, etc.) within the building. For example, the air handling unit 12 may be a heat pump that may heat or cool the air depending on how the heat pump is configured.

As shown in FIG. 1, the dehumidifier assembly 100 is configured to recirculate conditioned (e.g., indoor, etc.) air within the building to control the humidity of the conditioned air. The ventilation air (e.g., outdoor air, fresh air, etc.) and the conditioned air (e.g., indoor air, return air, recirculated air, etc.) are routed via lines (e.g., ducts, conduits, etc.) to separate inlets of the dehumidifier assembly 100. In the embodiment of FIG. 1, the ventilation air is routed through a vent line 14 that fluidly couples a first inlet 102 of the dehumidifier assembly 100 with an environment surrounding the building (e.g., an outdoor environment, etc.). The conditioned air is routed through a building air return line, shown as return line 16, which fluidly couples a second inlet 104 of the dehumidifier assembly 100 to a room, space, or zone within the building. As shown in FIG. 1, an outlet 106 of the dehumidifier assembly 100 is fluidly connected to an intermediate line 18, which fluidly couples the dehumidifier assembly 100 to an HVAC supply line 20 at a discharge end of the air handling unit 12. In the supply line 20, dry air leaving the dehumidifier assembly 100 mixes with conditioned air from the air handling unit 12 before being discharged into the building.

The arrangement of components in FIG. 1 is shown for illustrative purposes only. Various alternatives are possible without departing from the inventive concepts disclosed herein. For example, in some embodiments, the dehumidification system 10 is a standalone unit that delivers dry air directly into the supply line 20 and/or building, rather than to the air handling unit 12. The system 10 may also include various auxiliary components such as a filter to remove dirt and other particulate contamination from the incoming air.

As shown in FIG. 1, the system 10 includes a dehumidifier assembly 100 including a dehumidifier 200, an inlet manifold assembly 300, and a dehumidifier control system 400. In other embodiments, the dehumidifier assembly 100 may include additional, fewer, and/or different components. The dehumidifier 200 is configured to remove water from the air (e.g., the ventilation air and the conditioned air) to reduce the absolute humidity of the air delivered to the building. In the embodiment of FIG. 1, the dehumidifier 200 is an electric refrigeration dehumidifier that draws air across a refrigerated evaporator coil to remove moisture from the air. In other embodiments, the dehumidifier 200 may be another form of dehumidification unit. For example, the dehumidifier 200 may be a spray-type dehumidifier, an absorption/desiccant-type dehumidifier, or another type of dehumidifier. In some embodiments, the dehumidifier 200 includes a fan, blower, and/or another form of air driver to generate negative pressure (e.g., sub-ambient pressure) within the inlet manifold assembly 300, which draws air through the dehumidifier 200. The dehumidifier 200 may also include a drain line to direct condensate that has collected from the evaporator coils away from the dehumidifier 200 and out through a drain in the building.

Figure 3:
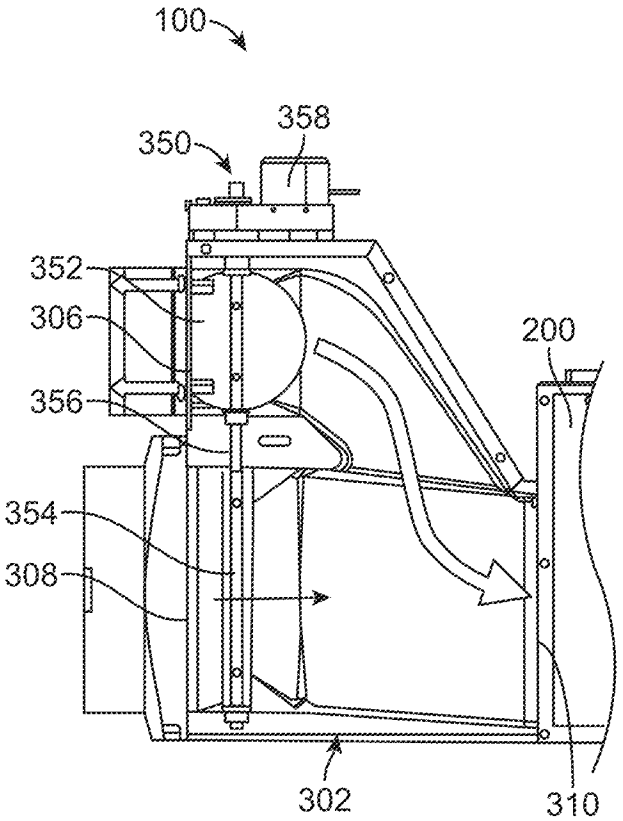
FIG. 3 is another side cross-sectional view of the inlet manifold assembly of FIG. 2.
Figure 2:
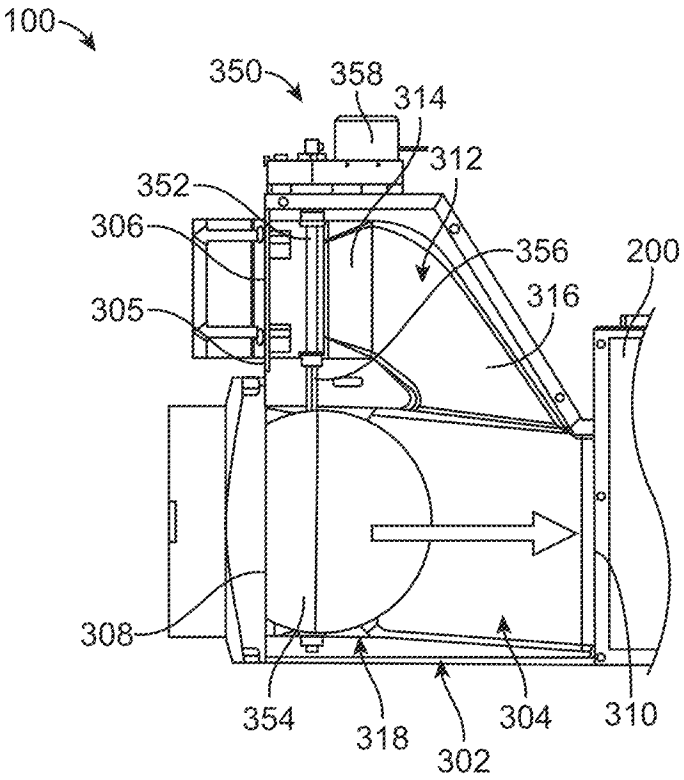
FIG. 2 is a side cross-sectional view of an inlet manifold assembly of the whole-building dehumidification system of FIG. 1.

FIGS. 2-3 show a cross-sectional view of the inlet manifold assembly 300 in two different operating states. The inlet manifold assembly 300 is configured to (i) receive air from the vent line 14 (e.g., the ventilation air, outdoor air, fresh air, etc.) and the return line 16 (e.g., conditioned air, return air, recirculated air, etc.); and to (ii) direct the air to an inlet of the dehumidifier 200. As shown in FIG. 2, the inlet manifold assembly 300 includes a body, shown as housing 302, and a damper assembly 350. The housing 302 has a plurality of side walls 305 that together define a fluid plenum 304 (e.g., a fluid receiving volume, etc.). The housing 302 may be integrally formed as a single unitary piece or from multiple pieces that are welded, bolted, or otherwise fastened together. For example, the housing 302 may be formed from sheet metal (e.g., galvanized steel) that is bent into the desired shape. In other embodiments, the housing 302 may be made from injected molded plastic, or from another type of material.

As shown in FIG. 2, the housing 302 defines a plurality of openings, including a first inlet opening 306, a second inlet opening 308, and an outlet opening 310. The first inlet opening 306 and the outlet opening 310 are disposed on different side walls of the housing 302, at opposite ends of the housing 302, along a flow direction through the housing 302. In the embodiment of FIG. 2, the first inlet opening 306 is disposed above the second inlet opening 308 (e.g., vertically above, etc.), on the same side wall 305 as the second inlet opening 308. The first inlet opening 306 is substantially vertically aligned with the second inlet opening 308. A central axis of the first inlet opening 306 is substantially parallel to a central axis of the second inlet opening 308 (i.e., the first inlet opening 306 axially faces in the same direction as the second inlet opening 308). In other embodiments, the arrangement of the first inlet opening 306 and the second inlet opening 308 may be different. For example, the first inlet opening 306 may be substantially horizontally aligned with the second inlet opening 308 (e.g., into the page as shown in FIG. 2) or misaligned with the second inlet opening 308 (e.g., at opposing corner regions of the same side wall 305, etc.). In another embodiment, the first inlet opening 306 may be disposed on a different side wall 305 of the housing 302 than the second inlet opening 308.

The first inlet opening 306 is a vent air inlet that is fluidly coupled to the vent line 14. The first inlet opening 306 is configured to receive ventilation air from the vent line 14; for example, from a fresh air intake on an exterior wall of the building through which outdoor air can enter the vent line 14 (see also FIG. 1). The second inlet opening 308 is a conditioned air inlet opening that is fluidly coupled to the return line 16. The second inlet opening 308 is configured to receive recirculated, conditioned air from the return line. The return line 16 may be fluidly connected to a damper on an interior wall of the building (e.g., within a room or zone of the building). In another embodiment, the second inlet opening 308 may be disconnected from the return line 16 and may receive conditioned air from within an area of the building that surrounds the housing 302. In the embodiment of FIG. 2, the first inlet opening 306 and the second inlet opening 308 are substantially circular. In another embodiment, the shape of the first inlet opening 306 and the second inlet opening 308 may be different.

As shown in FIG. 2, the second inlet opening 308 is larger than the first inlet opening 306. This difference in size is due, in part, to the efficiency improvements associated with drying recirculated building air and the comparatively low demand for fresh ventilation air. In one embodiment, the second inlet opening 308 is at least 1.5 times the size of the first inlet opening 306. For example, a diameter of the first inlet opening 306 may be approximately 6 inches and a diameter of the second inlet opening 308 may be approximately 10 inches. In another embodiment, the relative size of the openings may be different (e.g., the first inlet opening 306 may be the same size as the second inlet opening 308, etc.). Among other benefits, increasing the size of the second inlet opening 308 relative to the first inlet opening 306 ensures lower pressure drop across and greater airflow through the second inlet opening 308.

The fluid plenum 304 fluidly couples the first inlet opening, the second inlet opening, and the outlet opening. As shown in FIG. 2, the housing 302 defines two circular fluid passages or conduits extending between the inlet openings and the fluid plenum 304. A first conduit 312 includes a first portion 314 that extends in a substantially longitudinal direction (e.g., horizontal direction, flow direction, left and right as shown in FIG. 2) away from the first inlet opening 306, and a second portion 316 that extends at an angle from the first portion downwardly toward the fluid plenum 304. A second conduit 318 extends from the second inlet opening 308 in a substantially longitudinal direction toward the fluid plenum 304. In another embodiment, the arrangement, shape, and/or structure of the fluid passages of the housing 302 (e.g., fluid plenum 304, the first conduit 312, and/or the second conduit 318) may be different. In yet another embodiment, the housing 302 may not include any fluid conduits separate from the fluid plenum 304 (e.g., the inlets may discharge directly into the fluid plenum 304).

As shown in FIG. 3, the damper assembly 350 is configured to control the flow of air through the first inlet opening 306 and the second inlet opening 308. The damper assembly 350 includes a plurality of dampers including a first damper 352 and a second damper 354; a connecting member 356; and a damper actuator 358. The dampers are configured to selectively fluidly couple the inlet openings with the fluid plenum 304. In the embodiment of FIG. 3, the first damper 352 and the second damper 354 are damper blades formed as thin circular disks that rotate to selectively restrict the flow of air through the inlet openings. In other embodiments, the shape and/or structure of the dampers may be different. As shown in FIG. 3, each of the dampers is disposed proximate to a respective one of the inlet openings, immediately downstream of a respective one of the inlet openings. The first damper 352 is disposed within the first conduit 312 proximate to the first inlet opening 306 and the second damper 354 is disposed within the second conduit 318 proximate to the second inlet opening 308. As shown in FIG. 1, the first damper 352 is fluidly coupled to the vent line 14, which is fluidly coupled to an external environment surrounding the building. The second damper 354 is fluidly coupled to the return line 16 that is fluidly coupled to an internal environment of the building (e.g., a space within the building). As shown in FIG. 3, an outer diameter of each of the dampers is approximately the same as the inner diameter of a respective one of the fluid conduits so that rotation of the dampers selectively blocks the flow of air through a respective one of the fluid conduits. In one embodiment, the inlet manifold assembly 300 additionally includes sealing members to reduce air bypass between the dampers and the walls when the dampers are in a closed position (e.g., when the dampers are oriented substantially perpendicular to a flow direction through the fluid conduits to substantially block flow through the fluid conduits).

In the embodiment of FIG. 2, the second damper 354 is structured to allow a predefined amount of air to bypass the second damper 354 when the second damper 354 is in the closed position. For example, the second damper 354 may be undersized relative to the second conduit 318 such that a radial gap is formed between the outer perimeter of the second damper 354 and the inner wall of the second conduit 318. In another embodiment, the second damper 354 may be positioned such that the second damper 354 is not fully perpendicular relative to the flow direction when the second damper 354 is in the closed position. In yet another embodiment, the second damper 354 includes openings and/or perforations to allow some conditioned air to bypass the second damper 354 in the closed position. Among other benefits, allowing some predefined amount of bypass flow through the second damper 354 ensures that adequate dehumidifier capacity is maintained regardless of the position of the dampers (e.g., to ensure an approximately constant flow rate through the dehumidifier 200 during operation).

The connecting member 356 is coupled to both the first damper 352 and the second damper 354 and is configured to coordinate movement between the first damper 352 and the second damper 354. As shown in FIG. 2, the connecting member 356 extends through the housing 302 between the first conduit 312 and the second conduit 318. The connecting member 356 is directly mechanically connected to the first damper 352 and the second damper 354 and fixes the rotational position of the first damper 352 relative to the second damper 354 (e.g., the first damper 352 is fixedly coupled to the second damper 354). In the embodiment of FIG. 2, the connecting member 356 is a hexagonal shaft that extends through the first damper 352 and the second damper 354. In another embodiment, the connecting member 356 may be a cylindrical shaft or have another cross-sectional shape. Among other benefits, using a single connector to control movement of the dampers reduces the number of actuators, and the design complexity associated with separately actuated flow valves.

The connecting member 356 is configured to selectively permit the flow of air through one of the first inlet opening 306 and the second inlet opening 308 (e.g., either the first inlet opening 306 substantially independently from the second inlet opening 308, or the second inlet opening 308 substantially independently from the first inlet opening 306). As shown in FIGS. 2-3, the connecting member 356 is rotatable between a first position (e.g., a recirculation position, etc.) in which the first damper 352 is closed and the second damper 354 is open (FIG. 2), and a second position (e.g., a ventilation position) in which the first damper 352 is open and the second damper 354 is closed (FIG. 3). As used herein, the term "closed" refers to a position of the damper that substantially blocks flow through a respective one of the inlet openings (e.g., a position in which the damper is substantially perpendicular to the flow direction), whereas the term "open" refers to a position of the damper that permits flow (e.g., maximum flow) through a respective one of the inlet openings (e.g., a position in which the damper is substantially parallel to the flow direction). The first damper 352 is fixedly coupled to the connecting member 356 at a different angular position than the second damper 354. In the embodiments of FIGS. 2-3, the first damper 352 is rotated approximately 90° with respect to the second damper 354 such that the first damper 352 is substantially perpendicular with respect to the second damper 354. Among other benefits, the arrangement of the damper assembly 350 allows ventilation air to be provided to the dehumidifier 200 substantially independently from the conditioned air. Additionally, when the second damper 354 is closed, ventilation air can be provided to the dehumidifier 200 at a much higher flow rate because the pressure at the outlet of the vent line 14 is less than can be achieved when the second damper 354 is open. For example, in the embodiment of FIGS. 2-3, the flow rate of ventilation air may be at least two times greater than can be achieved when both inlet openings are open (e.g., three times greater), without impacting power consumption. In other words, the ventilation efficacy (the ratio of the flow rate of the ventilation air divided by the amount of power needed to draw in the ventilation air) may be at least two to three times greater as compared to traditional dehumidifier systems. Substantially isolating the flow of ventilation air from the conditioned air also allows for independent measurement of and reaction to the fluid properties of the ventilation air, as will be further described with reference to FIGS. 4-5.

As shown in FIGS. 2-3, the damper actuator 358 is coupled to the connecting member 356 and is configured to move the connecting member 356 to selectively open one of the first inlet opening 306 and the second inlet opening 308. The damper actuator 358 is engaged with and coupled to an upper side wall of the housing 302. In other embodiments, the damper actuator 358 may be located at another position along the housing 302. The damper actuator 358 may be a rotary actuator (e.g., an electrically powered actuator, etc.) configured to rotate the connecting member 356 in response to a control signal from the dehumidifier control system 400 and/or a humidity controller separate from the dehumidifier assembly 100. The damper actuator 358 may include a spring to position the connecting member 356 (by default) in the first position (e.g., in the absence of an electrical signal to the damper actuator 358) to increase the operating life of the damper actuator 358.

Returning to FIG. 1, the dehumidifier assembly 100 includes a dehumidifier control system, shown as control system 400, configured to receive commands and to control operation of the dehumidifier 200 and the inlet manifold assembly 300 (e.g., the damper assembly 350, the damper actuator 358, etc.). The control system 400 is also configured to monitor operations of the dehumidifier assembly 100 (e.g., fluid properties of the air passing through the dehumidifier assembly 100, etc.). As shown in FIG. 1, the control system 400 includes a humidity controller 402 (e.g., control unit, etc.) and at least one sensor 404. In other embodiments, the control system 400 may include additional, fewer, and/or different components. In the embodiment of FIG. 1, the humidity controller 402 is mounted on or in the dehumidifier 200 (e.g., onto a side wall of the dehumidifier 200). In another embodiment, the humidity controller 402 may be mounted separately from the dehumidifier 200. For example, the humidity controller 402 may be a thermostat or other control unit that is mounted to an interior wall of the building at a different location from the dehumidifier 200. In an embodiment where a separate input is used from a remote thermostat/control unit, the dehumidifier 200 (e.g., the fan and the compressor) may be turned on and off in response to the input. In other embodiments, the humidity controller 402 may be a remote computing device such as a mobile phone, tablet, a laptop computer, or another portable computing device.

The humidity controller 402 may include a power source, which may be any wired or wireless power supply; memory configured to store (i) sensor data from the at least one sensor 404, (ii) user inputs, and (iii) system operating parameters and settings; a user interface configured to receive user inputs and/or present information to a user; a communications interface (e.g., a transceiver, etc.) configured to receive and/or transmit data from the humidity controller to other components of the dehumidification system 10; and a processor operatively coupled to each of the components of the humidity controller 402 and configured to coordinate operations between the components. In one embodiment, memory may include a non-transitory computer-readable medium configured to store computer-readable instructions for the humidity controller 402 that when executed by the processor, cause the humidity controller 402 to provide a variety of functionalities as described herein. In other embodiments, the humidity controller 402 includes additional, fewer, and/or different components.

The at least one sensor 404 is configured to measure fluid properties and/or environmental conditions within the building. In one embodiment, the control system 400 includes multiple sensors 404 including a temperature sensor configured to determine (e.g., measure) the temperature of the air and a relative humidity sensor configured to determine the relative humidity of the air. In other embodiments, the control system 400 may also include a dew point sensor and/or another type of environmental condition measurement sensor.

In the embodiment of FIG. 1, the sensors 404 are disposed within the dehumidifier 200 at an inlet end of the dehumidifier 200, and are configured to monitor fluid properties of the air entering the dehumidifier 200. Among other benefits, measuring the conditions of the air entering the dehumidifier 200 provides real-time data about the performance of the dehumidifier 200 and the quality of air entering the dehumidification system 10 (e.g., the quality of the ventilation air). In another embodiment, at least one of the sensors 404 may be part of a thermostat or another control and/or monitoring device that is mounted separately from the dehumidification system 10 (e.g., in a room and/or zone within the building).

The humidity controller 402 is configured to control the dehumidifier 200 and the inlet manifold assembly 300 to reduce fluctuations in the absolute humidity that can occur when ventilating the building. The humidity controller 402 is configured to control operation of the dehumidifier 200 based on two different humidity control settings. When conditioned air is being recirculated through the dehumidifier assembly 100 (e.g., when the connecting member 356 is in the first position as shown in FIG. 2), the humidity controller 402 controls the dehumidifier based on the relative humidity (e.g., percent relative humidity) of the air entering the dehumidifier 200 (e.g., the air passing through the sensor 404 at the inlet end of the dehumidifier, and/or at another control location within the building). During ventilation (e.g., when the connecting member 356 is in the second position as shown in FIG. 3), the humidity controller 402 controls the dehumidifier 200 based on the dew point of the air entering the dehumidifier 200.

Figure 4:
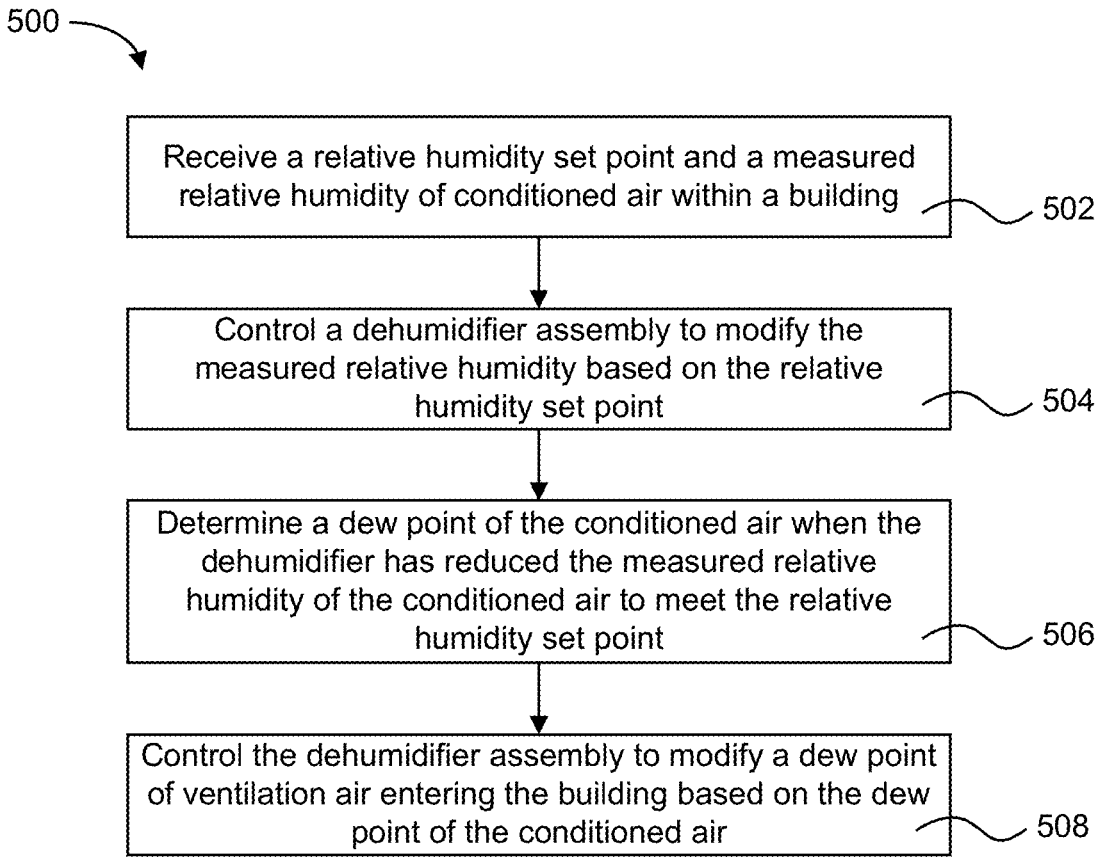
FIG. 4 is flow diagram of a method of conditioning air using a whole-building dehumidification system, according to an embodiment.

Referring to FIG. 4, a flow diagram of a method 500 of conditioning air using a whole-building dehumidification system is shown, according to an embodiment. The method 500 may be implemented using the humidity controller 402 of FIG. 1, for example, through a software application installed on the humidity controller 402. As such, reference will be made to the humidity controller 402 when describing method 500. In another embodiment, the method 500 may include additional, fewer, and/or different operations. It will be appreciated that the use of a flow diagram and arrows is not meant to be limiting with respect to the order or flow of operations. For example, in one embodiment, two or more of the operations of method 500 may be performed simultaneously.

At operation 502, the humidity controller 402 receives a relative humidity set point and a measured relative humidity of conditioned air within the building. Operation 502 may include receiving a relative humidity set point (e.g., a user-specified RH %) via the user interface of the humidity controller 402, and/or via a remote computing device that is communicably coupled to the humidity controller 402 (e.g., via a thermostat using the communications interface of the humidity controller 402). The relative humidity set point may be indicative of a comfort level that the user is trying to achieve within the building. Operation 502 may also include measuring the relative humidity (e.g., the actual RH %) at an inlet end of a dehumidifier (e.g., dehumidifier 200) using a relative humidity sensor (e.g., sensor 404). In another embodiment, operation 502 includes receiving relative humidity data from a relative humidity sensor that is disposed within the building but remotely from the humidity controller 402 (e.g., in a thermostat, etc. that is mounted in a different room from the dehumidifier). In such an embodiment, the humidity controller 402 also includes a separate sensor to monitor the condition of air entering from the vent line (e.g., within the vent line, or on/in the inlet end of the dehumidifier 200). Operation 502 may include receiving the relative humidity data via the communications interface of the humidity controller 402.

At operation 504, the humidity controller 402 controls the dehumidifier assembly to modify the measured relative humidity based on the relative humidity set point. Operation 504 may include activating a fan of the dehumidifier and controlling a damper assembly (e.g., damper assembly 350) to draw conditioned air into the dehumidifier substantially independently from outdoor ventilation air. Operation 504 may include moving a connecting member (e.g., connecting member 356) of the dehumidifier assembly to reposition a first damper (e.g., first damper 352) of the damper assembly in a closed position and to reposition a second damper (e.g., second damper 354) of the damper assembly in an open position. For example, operation 504 may include sending a control signal to a damper actuator (e.g., damper actuator 358) to rotate a connecting member (e.g., connecting member 356) of the damper actuator into the first position as shown in FIG. 2. In another embodiment, operation 504 includes selectively repositioning multiple dampers within the dehumidifier assembly. For example, operation 504 may include repositioning the first damper of the damper assembly in the closed position to substantially restrict the flow of ventilation air into the dehumidifier, and repositioning the second damper of the damper assembly in the open position to permit the flow of conditioned air into the dehumidifier. Operation 504 may include drawing conditioned air into the dehumidifier (e.g., via the return line 16 of FIG. 1) for a predefined time period to ensure that air passing through the dehumidifier (and past the sensor 404 located proximate to the discharge end of the dehumidifier) is representative of the source to be measured (e.g., that the air passing through the dehumidifier is representative of the actual state of the conditioned air within the building). For example, operation 504 may include drawing conditioned air into the dehumidifier until a rate of change of a measured property of the conditioned air (e.g., sensor data from sensor 404) is less than a threshold rate of change. Operation 504 may include continuously querying relative humidity data from the relative humidity sensor while drawing conditioned air through the dehumidifier. Operation 504 may include comparing the relative humidity data with the relative humidity set point and selectively activating the dehumidifier (e.g., the compressor of the dehumidifier) to remove moisture from the conditioned air. For example, if the relative humidity data is higher than the relative humidity set point by an activation threshold value (e.g., an amount above the relative humidity set point that an occupant can comfortably tolerate such as 3%, etc.), the humidity controller 402 may be configured to activate the dehumidifier compressor. In this scenario, the relative humidity set point is a minimum set point value below which no further dehumidification of the conditioned air is required. The humidity controller 402 may be configured to operate the dehumidifier compressor until the relative humidity data is equal to the relative humidity set point. In another embodiment, the relative humidity set point is a maximum set point value above which the dehumidifier compressor is activated. In this scenario, dehumidification continues until relative humidity data is less than the relative humidity set point by a deactivation threshold value (e.g., some comfort level below the relative humidity set point). In other embodiments, operation 504 may include selectively activating the dehumidifier to remove moisture from the conditioned air until the relative humidity data is within a threshold range of the relative humidity set point.

At operation 506, the humidity controller 402 determines an actual dew point of the conditioned air after the space dehumidification demand has been achieved. Operation 506 may include receiving temperature data and relative humidity data from the sensors within the building and/or at the inlet of the dehumidifier. Operation 506 may also include receiving indoor air temperature data from a temperature sensor disposed within the building and relative humidity data from a relative humidity sensor disposed in the building. The temperature and relative humidity sensor may be located remotely from the dehumidifier assembly, or may be integral with of the dehumidifier assembly. For example, the temperature and/or relative humidity sensor may be disposed upstream of the dehumidifier (e.g., at an inlet end of the dehumidifier (sensor 404), between the dehumidifier coils. Operation 506 may further include calculating the actual dew point based on the relative humidity data and the indoor air temperature data. For example, the humidity controller 402 may calculate the actual dew point using an approximation based on the relative humidity data and the indoor temperature data. In another embodiment the humidity controller 402 calculates the dew point by crawling through a lookup table—stored in controller memory—that includes values of dew point as a function of different values of relative humidity and temperature. Among other benefits, determining the actual dew point of the conditioned air after the space dehumidification demand has been achieved provides the most accurate approximation of the absolute moisture level within the building. In another embodiment, operation 506 may include approximating the actual dew point using user-specified set points for temperature and relative humidity.

At operation 508, the humidity controller 402 controls the dehumidifier assembly to modify a dew point of the ventilation air entering the building based on the dew point of the conditioned air. Operation 508 may include determining when to ventilate using the humidity controller 402; for example, by using variables, input by the user, that are necessary to determine when and how often to ventilate. In other embodiments, a separate input to the dehumidifier assembly (e.g., humidity controller 402) is used to determine when to ventilate. Operation 508 may include updating a dew point set point of the humidity controller 402 (e.g., stored in memory) based on the actual dew point of the conditioned air after the conditioned space dehumidification demand is satisfied, as determined in operation 506. For example, if the initial (default) ventilation dew point set point in the humidity controller 402 was 58° F., that setting would be used as the dew point set point until operations 504 is complete (e.g., until the first conditioned space dehumidification demand). At the end of operation 506, if the dew point data indicates that the actual dew point of the conditioned air is 55° F., then the new dew point set point would be some preset value above or below 55° F. (e.g., a minimum value of the dew point set point below which the dehumidifier should turn-off to prevent further dehumidification of the ventilation air to maintain an average dew point set point of 55° F., or a maximum desired value of the dew point set point above which the dehumidifier should turn-on to reduce the moisture level of the ventilation air and maintain an average dew point set point of 55° F.). In another embodiment, the humidity controller 402 may update the dew point set point to be equal to the actual dew point of the conditioned air (e.g., 55° F.). Operation 508 may include activating a fan of the dehumidifier and controlling the damper assembly to draw outdoor ventilation air into the dehumidifier substantially independently from the conditioned air. Operation 508 may include moving the connecting member of the dehumidifier assembly to reposition the first damper of the damper assembly in the open position and to reposition the second damper of the damper assembly in a closed position. For example, operation 508 may include sending a control signal to the damper actuator to rotate the connecting member into the second position as shown in FIG. 3. In another embodiment, operation 508 includes selectively repositioning a first damper in the open position to permit the flow of ventilation air into the dehumidifier, and repositioning the second damper in the closed position to substantially restrict the flow of conditioned air into the dehumidifier.

Operation 508 may further include receiving (e.g., continuously querying) dew point data indicative of a dew point of the ventilation air (e.g., an actual dew point) passing through (e.g., entering) the dehumidifier assembly. For example, receiving dew point data may include receiving both temperature data and relative humidity data from the sensors at the inlet end of the dehumidifier and iteratively calculating the dew point as described in operation 506. Unlike the fluid properties of the conditioned air, which can be monitored remotely from the dehumidifier assembly, the fluid properties of the ventilation air are monitored at a location before the ventilation air is dehumidified within the dehumidifier. Dehumidification of the ventilation air can therefore be achieved before the ventilation air enters the building and has a chance to absorb into the materials of the building providing for a capacitive effect on the moisture load in the building that can reduce the effectiveness of the whole-building dehumidification system. Operation 508 may further include comparing the dew point data with the dew point set point and selectively activating the dehumidifier (e.g., the compressor of the dehumidifier) to remove moisture from the ventilation air. For example, if the dew point data is higher than the dew point set point by an activation threshold value (e.g., an amount above dew point set point that an occupant can comfortably tolerate), the humidity controller 402 may be configured to activate the dehumidifier compressor. In this scenario, the dew point set point is a minimum set point value below which no further dehumidification of the ventilation air is required. The humidity controller 402 may be configured to operate the dehumidifier compressor until the dew point data is equal to the dew point set point. In another embodiment, the dew point set point is a maximum set point value above which the dehumidifier compressor is activated. In this scenario, dehumidification continues until the dew point data is less than the dew point set point by a deactivation threshold value (e.g., some comfort level below the dew point set point). In other embodiments, operation 508 may include selectively activating the dehumidifier to remove moisture from the conditioned air until the dew point data is within a threshold range of the dew point set point, and/or is less than or equal to the dew point set point.

Figure 5:
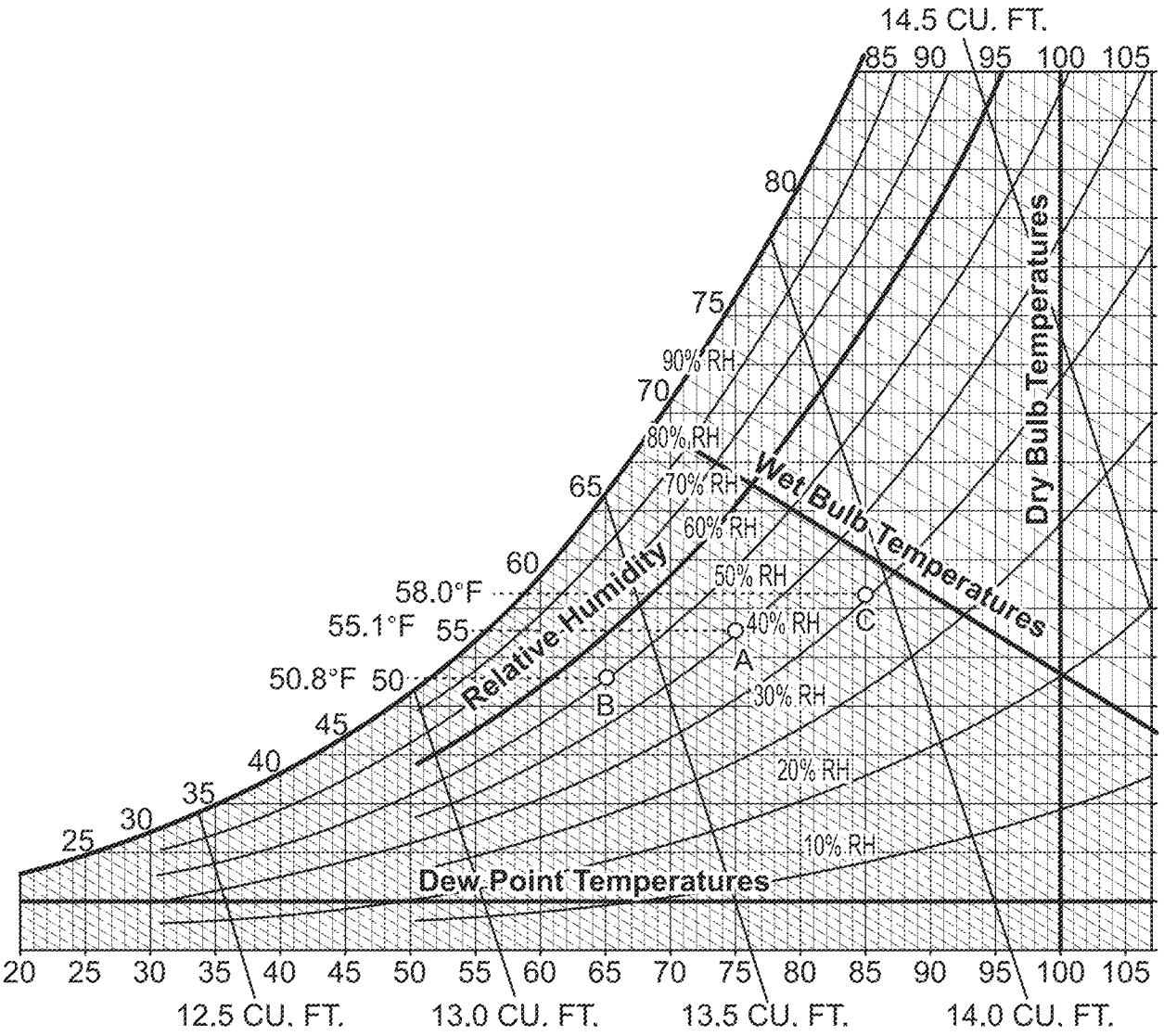
FIG. 5 is a psychometric diagram that shows various example control points for the whole-building dehumidification system of FIG. 1, according to an embodiment.

FIG. 5 is a psychometric chart that illustrates some of the benefits associated with the design of the inlet manifold structure of FIGS. 1-3 and the control approach described with reference to FIG. 4. In particular, FIG. 5 shows multiple control points overlaid onto the psychometric chart. Point A represents a user-specified comfort condition for the building (e.g., a user-specified environmental condition corresponding to a comfort condition for the building). In this example, point A corresponds to a temperature of approximately 75° F. and a relative humidity of approximately 50%. As shown in FIG. 5, the dew point of the conditioned air at the user-specified comfort condition is approximately 55.1° F. Assume that a first outdoor condition is represented by point B, which corresponds with environmental conditions of approximately 65° F. and 60% relative humidity (dew point is approximately 50.8° F.). Although the relative humidity of the outdoor air is higher than the conditioned air, the absolute humidity is actually lower (e.g., the dew point at point B is less than the dew point of the conditioned air). Assume that a second outdoor condition is represented by point C, which corresponds with environmental conditions of approximately 85° F. and 40% relative humidity (dew point is approximately 58° F.). Although the relative humidity of the outdoor air at point C is less than the conditioned air, the absolute humidity of the outdoor air is actually greater than the conditioned air (e.g., the dew point at point C is greater the dew point of the conditioned air). As a result of these differences, dehumidifying the outdoor air based on the relative humidity alone would cause large fluctuations in the absolute humidity of the indoor air, resulting in poor system efficiency and user comfort. The system of the present disclosure accounts for differences in moisture level of the outdoor air by controlling the dehumidifier based on the dew point of the incoming ventilation air, rather than the relative humidity, while still relying on traditional environmental inputs (e.g., the RH % and temperature) that are familiar to most users.

The arrangement of the dehumidification system may be different in various embodiments. For example, in at least one embodiment, the manifold assembly may be an outlet manifold assembly that is positioned at and fluidly coupled to an outlet of the dehumidifier, rather than the inlet of the dehumidifier. Additionally, in at least one embodiment, the dehumidification system is structured to selectively control the introduction of vent air into the building based on whether the dew point of air external to the building (e.g., in an outside environment, etc.) is less than a dew point set point. In this way, the manifold assembly can be used to reduce the overall load on the dehumidifier (e.g., the mechanical refrigeration system) and improve the energy efficiency of the dehumidification system.

Figure 6:
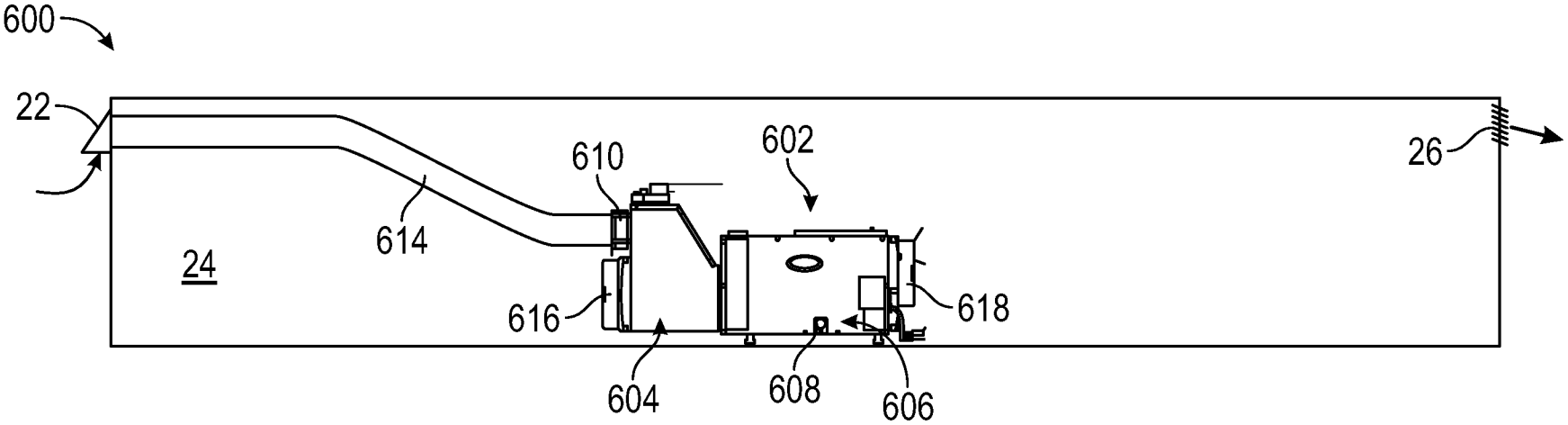
FIG. 6 is a schematic diagram of a dehumidification system in a first mode of operation, according to an embodiment.
Figure 7:
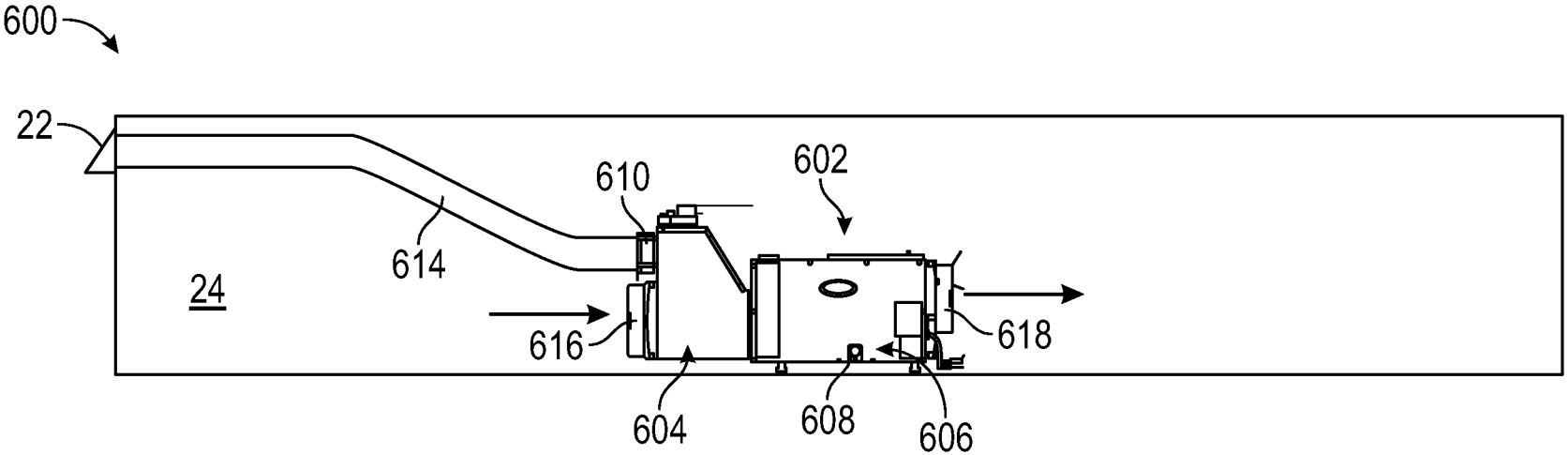
FIG. 7 is a schematic diagram of the dehumidification system of FIG. 6 in a second mode of operation, according to an embodiment.

For example, FIGS. 6-7 show a dehumidification system 600 that is arranged within a crawl space of a building and is configured to control the moisture levels within the crawl space. In another embodiment, the dehumidification 600 may be positioned at another location within the building, and/or may include ducting to direct the flow of conditioned air from the dehumidifier 602 into different spaces in the building that are remote from where the dehumidifier 602 is located. As shown in FIGS. 6-7, the dehumidification system 600 includes the dehumidifier 602, a manifold assembly 604 having an outlet coupled to an inlet end of the dehumidifier 602, and a control system 606 configured to determine the moisture level of air entering the dehumidifier 602 from the manifold assembly 604. In the embodiment of FIGS. 6-7, the control system 606 includes a sensor 608 (e.g., a dew point sensor, a combination of a relative humidity sensor and temperature sensor, etc.) disposed upstream of the dehumidifier coils in an inlet portion of the dehumidifier 602, or at another location along the dehumidifier 602 or manifold assembly 604. In at least one embodiment, the manifold assembly 604 is the same as or similar to the inlet manifold assembly 300 described with reference to FIGS. 1-3.

As shown in FIGS. 6-7, the first opening 610 (e.g., upper opening, vent air opening, etc.) of the manifold assembly 604 is fluidly coupled to a vent intake opening 22 exterior to the building via a vent line 614. The second opening 616 (e.g., lower opening, return air opening, etc.) of the manifold assembly 604 is fluidly coupled to the crawl space 24 within the building and is configured to receive air from within the crawl space (e.g., conditioned air, indoor air, etc.). An outlet 618 of the dehumidifier 602 is fluidly coupled to the crawl space 24 and is configured to exhaust conditioned air from the dehumidifier 602 into the crawl space 24.

The dehumidification system 600 is configured to periodically monitor a moisture level (e.g., a dew point, etc.) of air exterior to the building (e.g., an outside environment) and to switch between two different operating modes depending on whether the moisture level of the outdoor air is less than a humidity setting to improve the energy efficiency of the dehumidification system 600. For example, in at least one embodiment, the dehumidification system 600 is configured to periodically sample the air in the crawl space 24 and the outdoor air separately by switching the connecting member in the manifold assembly 604, to draw in either conditioned air from the crawl space 24 through the second opening 616 or outdoor air through the first opening 610. The system 600 is further configured to draw in air that has the lowest moisture level (e.g., dew point) to dehumidify the crawl space 24, and to thereby reduce the load on the dehumidifier or to remove the load entirely if the vent air is sufficiently dry in comparison to the desired humidity setting.

As shown in FIG. 6, if the moisture level of the outdoor air is sufficiently below the humidity setting, the system 600 is configured to operate in a first mode in which the connecting member is repositioned to draw in dry vent air into the crawl space. The incoming vent air displaces air in the crawl space 24, which is exhausted through a vent exhaust opening 26 in the building. As shown in FIG. 7, if the moisture level of the vent air is above the setting (or above some threshold value that is below the setting), the system 600 is configured to operate in a second mode in which the connecting member is repositioned to draw in conditioned air from the crawl space 24, and to operate the compressor of the dehumidifier to remove moisture from the crawl space 24 until the moisture level drops sufficiently below the setting. In the embodiment of FIGS. 6-7, the sensor 608 within the dehumidifier 602 measures air conditions within both the crawl space 24 and the incoming outdoor and/or vent air.

Figure 8:
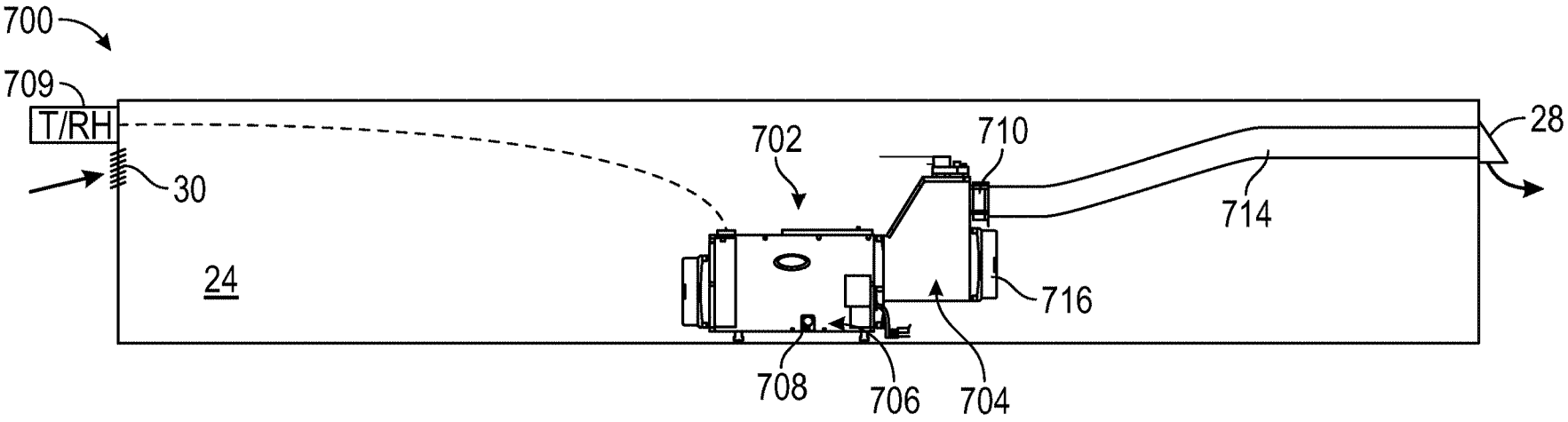
FIG. 8 is a schematic diagram of a dehumidification system in a first mode of operation, according to another embodiment.
Figure 9:
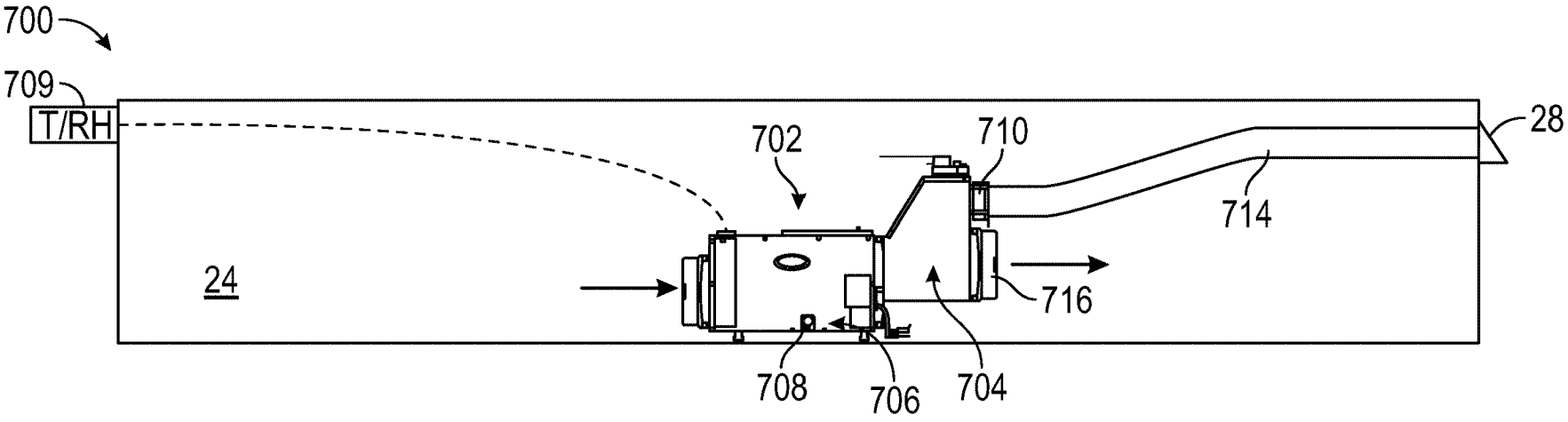
FIG. 9 is a schematic diagram of the dehumidification system of FIG. 8 in a second mode of operation, according to an embodiment.

FIGS. 8-9 show a dehumidification system 700 that is similar to the system 600 of FIGS. 6-7, but where an inlet of the manifold assembly 704 is positioned at and fluidly coupled to an outlet of the dehumidifier 702. In the arrangement of FIGS. 6-7, the system 700 additionally includes an external sensor 709 that measures the moisture level of outdoor air external to the building and transmits the measurement data to other parts of the control system 706 (e.g., via a wired or wireless connection to the controller and/or network interface of the control system). The system 700 may also include the sensor 708 in the dehumidifier 702 to periodically sample the moisture level of the air within the crawl space 24. As shown in FIG. 8, if the moisture level of the outdoor air is sufficiently below the humidity setting, the system 700 is configured to operate in a first mode in which a damper actuator within the manifold assembly is repositioned to exhaust conditioned air through the first opening 710, through a vent line 714 to a vent exhaust opening 28 that fluidly couples the vent line 714 with the outdoor environment. In this mode of operation, the air exhausted from the crawl space 24 through the vent exhaust opening 28 is replaced by fresh vent/outdoor air that enters the crawl space 24 through a vent intake opening 30. As shown in FIG. 9, if the moisture level of the outdoor air is above the setting (or above some threshold value that is below the setting), the system 700 is configured to operate in a second mode in which the dehumidifier 702 is activated and the connecting member is repositioned to exhaust conditioned air back into the crawl space 24 through the second opening 716.

Figure 10:
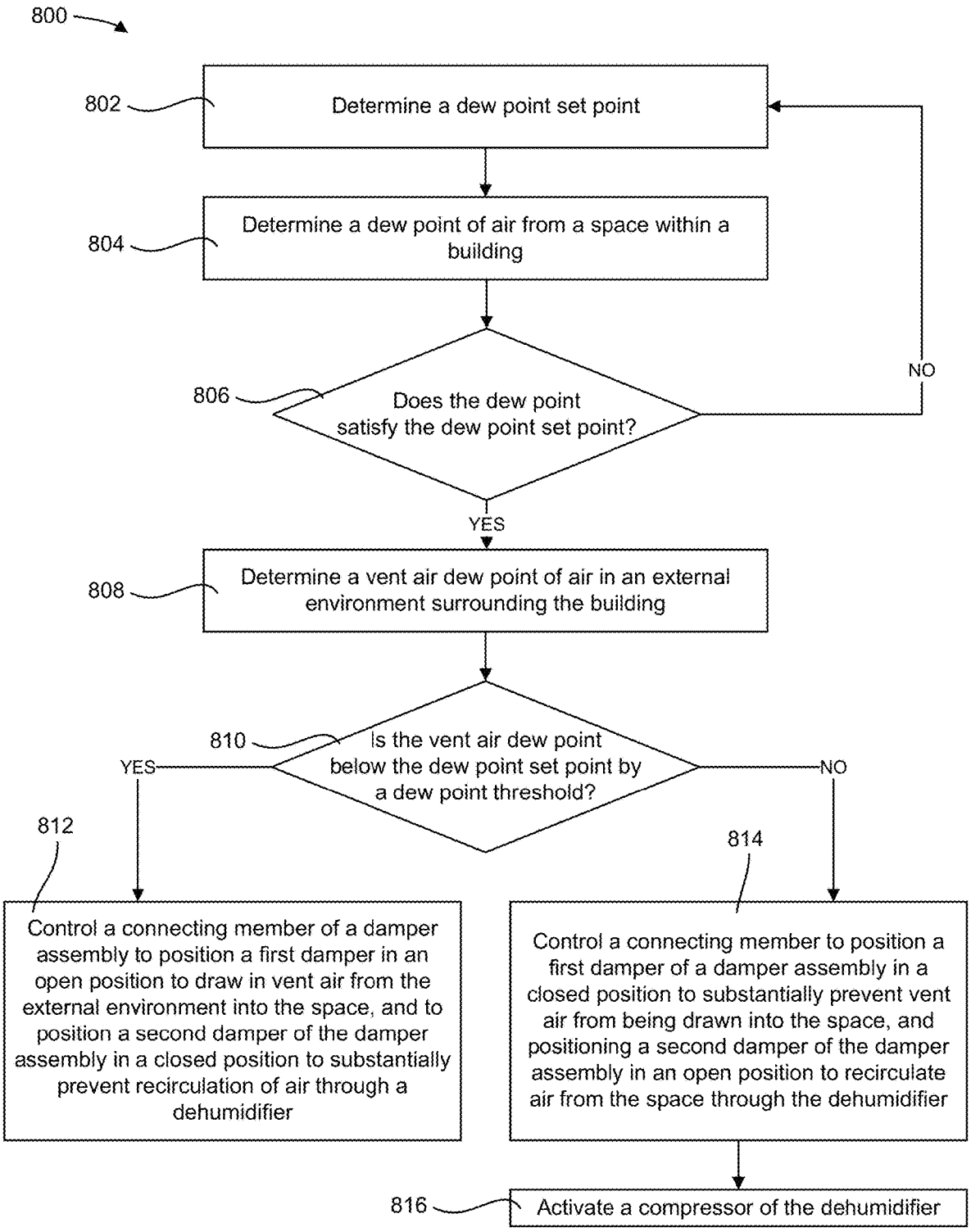
FIG. 10 is a flow diagram of a method of conditioning air using a dehumidification system, according to another embodiment.

Referring to FIG. 10, a flow diagram of a method 800 of conditioning air using a whole-building dehumidification system is shown, according to an embodiment. The method 800 may be implemented using a humidity controller and/or control systems of FIG. 6-7 or 8-9. In another embodiment, the method 800 may include additional, fewer, and/or different operations. It will be appreciated that the use of a flow diagram and arrows is not meant to be limiting with respect to the order or flow of operations. For example, in one embodiment, two or more of the operations of method 800 may be performed simultaneously.

At operation 802, the humidity controller determines a dew point set point. Operation 702 may include receiving, via a user interface, a moisture setting (e.g., a relative humidity, etc.) that is indicative of a desired moisture level of the space within the building. In one embodiment, operation 802 may further include receiving a temperature of the air within the space, for instance, by receiving measurement data from the sensor that is positioned in the dehumidifier. Operation 802 may include calculating the dew point set point based on the moisture setting and/or the temperature of air within the space (e.g., as being approximately equal to the dew point at the moisture setting and the temperature of the space, or as being a threshold value below the dew point at the moisture setting and the temperature of the space, etc.).

At operation 804, the humidity controller determines a dew point of air from the space within the building. In the embodiments of FIGS. 6-9, operation 804 may include moving a connecting member of the manifold assembly to reposition a first damper of a damper assembly (e.g., a first damper that is fluidly coupled to a vent line and external environment surrounding the building) into a closed position and a second damper of the damper assembly (e.g., a second damper that is fluidly coupled to a return line and/or space within the building) into an open position. Operation 804 may also include controlling an air driver (e.g., fan, blower, etc.) of the dehumidifier to draw air from the space across the sensor of the dehumidifier, and measuring, via the sensor, the dew point of the air over a conditioned air sampling period (e.g., until the measured moisture level stabilizes across the sensor, etc.). In yet other embodiments, operation 804 may include receiving moisture level measurements of the indoor air from a wall-mounted thermostat or other sensor that is remote from the dehumidifier, and determining the dew point of air within the space from the moisture level measurements.

At operation 806, the humidity controller determines whether the dew point satisfies the dew point set point. As used herein, the term "satisfies" or "satisfied" may refer to a scenario in which a measured value (e.g., the dew point of indoor air) is above a set point value (e.g., the dew point set point), and/or greater than or substantially equal to the set point value. In the event that the dew point of the indoor air does not satisfy the dew point set point, the method 800 may repeat to continue monitoring conditions within the space. In response to determining that the dew point satisfies (e.g., exceeds, is greater than or substantially equal to, etc.) the dew point set point, the method 800 continues to operation 808.

At operation 808, the humidity controller determines a dew point of air in an environment surrounding the building (e.g., a vent air dew point). In the dehumidification system 600 of FIGS. 6-7, operations 804 and 808 together may include continually monitoring conditions within the space and in the outdoor environment by periodically sampling the air from both the indoor space and the outdoor environment. For example, the humidity controller may periodically sample indoor and outdoor air by moving the connecting member to redirect air across the sensor from both the space and the outdoor environment, by moving the connecting member between a first position in which the first damper (e.g., that is fluidly coupled to a vent line and external environment surrounding the building) is in a closed position and the second damper (e.g., that is fluidly coupled to a return line and/or space within the building) is in an open position, and a second position in which the first damper is in the open position and the second damper is in the closed position. Operation 808 may also include controlling an air driver to draw vent air across the sensor of the dehumidifier and measuring, via the sensor, the dew point of the vent air over a vent air sampling period (e.g., until the measured dew point stabilizes, or a rate of change of the measured dew point drops below a threshold rate of change, etc.). In the embodiment of FIGS. 8-9, operation 808 may include receiving vent air moisture level measurements of the outdoor air from the external sensor that is mounted on an exterior of the building and/or in another outdoor location that is remote from the dehumidification system, through a wired and/or wireless connection (e.g., via a network interface of the control system), and determining the vent air dew point from the vent air moisture sensor measurements.

At operation 810, the humidity controller determines whether the vent air dew point is sufficiently below the dew point set point such that the indoor moisture level may be reduced without operating the dehumidifier. For example, the humidity controller may compare the vent air dew point to the dew point set point to determine whether the vent air dew point is below the dew point set point by a dew point threshold. The dew point threshold may be a user specified threshold value, or a threshold value that is preprogrammed into memory of the control system (e.g., 5° less than the dew point set point, 2° less than the dew point set point, 1° less than the dew point set point, etc.). As shown in FIG. 10, in response to determining that the vent air dew point is below the dew point set point by the dew point threshold, the humidity controller controls the damper actuator of the manifold assembly to draw in vent air from the external environment into the space, and to substantially prevent recirculation of air through the dehumidifier, at operation 812. Operation 812 may include sending a control signal to the damper actuator, via a network and/or communications interface of the control system, to control the connecting member to position the first damper in the open position to draw outdoor air into the space and to position the second damper in the closed position to substantially prevent recirculation of indoor air through the dehumidifier. Operation 812 may further include activating an air driver of the dehumidifier to draw in vent air through the first opening (FIGS. 6-7), and/or to exhaust conditioned air from the space to an environment surrounding the building (FIGS. 8-9).

In response to determining that the vent air dew point satisfies the dew point set point (e.g., is above the dew point set point, is within the dew point threshold of the dew point set point, etc.), the humidity controller controls the damper actuator of the manifold assembly to substantially prevent vent air from being drawn into the space, and to recirculate air from the space through the dehumidifier, at operation 814. Operation 814 may include sending a control signal to the damper actuator, via a network and/or communications interface of the control system, to control the connecting member to position the second damper in the open position to recirculate air from the space through the dehumidifier and to position the first damper in the closed position to substantially prevent introduction of outdoor air into the space. Operation 812 may further include activating an air driver of the dehumidifier to draw in air from the space through the second opening (FIGS. 6-7), and/or to exhaust conditioned air through the second opening (FIGS. 8-9). At operation 816, the humidity controller activates a compressor of the dehumidifier; for example, by sending a control signal to a compressor motor, to reduce the moisture level of the air being recirculated through the dehumidifier.

As utilized herein, the terms "approximately," "about," "substantially," and similar terms are intended to have a broad meaning in harmony with the common and accepted usage by those of ordinary skill in the art to which the subject matter of this disclosure pertains. It should be understood by those of skill in the art who review this disclosure that these terms are intended to allow a description of certain features described and claimed without restricting the scope of these features to the precise numerical ranges provided. Accordingly, these terms should be interpreted as indicating that insubstantial or inconsequential modifications or alterations of the subject matter described and claimed are considered to be within the scope of the application as recited in the appended claims.

The terms "coupled," "connected," and the like, as used herein, mean the joining of two members directly or indirectly to one another. Such joining may be stationary (e.g., permanent) or moveable (e.g., removable or releasable). Such joining may be achieved with the two members or the two members and any additional intermediate members being integrally formed as a single unitary body with one another or with the two members or the two members and any additional intermediate members being attached to one another.

References herein to the positions of elements (e.g., "top," "bottom," "above," "below," etc.) are merely used to describe the orientation of various elements in the FIGURES. It should be noted that the orientation of various elements may differ according to other exemplary embodiments, and that such variations are intended to be encompassed by the present disclosure.

It is important to note that the construction and arrangement of the apparatus and control system as shown in the various exemplary embodiments is illustrative only. Although only a few embodiments have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter described herein. For example, elements shown as integrally formed may be constructed of multiple parts or elements, the position of elements may be reversed or otherwise varied, and the nature or number of discrete elements or positions may be altered or varied. The order or sequence of any process or method steps may be varied or re-sequenced according to alternative embodiments.

Other substitutions, modifications, changes and omissions may also be made in the design, operating conditions and arrangement of the various exemplary embodiments without departing from the scope of the present application. For example, any element disclosed in one embodiment may be incorporated or utilized with any other embodiment disclosed herein.

What is claimed is:

1. A method, comprising:

determining a dew point set point;

determining a dew point of conditioned air from a space within a building;

in response to determining that the dew point satisfies the dew point set point, determining a vent air dew point of air in an external environment surrounding the building;

in response to determining that the vent air dew point is below the dew point set point by a dew point threshold:

controlling a connecting member of a damper assembly to position a first damper of the damper assembly in an open position to exhaust conditioned air to a vent exhaust opening fluidly coupled to the external environment, and to position a second damper of the damper assembly in a closed position to substantially prevent recirculation of the conditioned air to the space within the building; and controlling an air driver of an dehumidifier to exhaust the conditioned air from the space through the dehumidifier to the external environment; and in response to determining that the vent air dew point satisfies the dew point set point or is within the dew point threshold of the dew point set point:

activating a compressor of the dehumidifier to reduce a moisture level of the conditioned air within the space within the building; and controlling the connecting member to position the first damper in the closed position to substantially prevent exhausting the conditioned air to the vent exhaust opening and positioning the second damper in the open position to circulate the conditioned air to the space within the building.

2. The method of claim 1, further comprising:

in response to determining that the vent air dew point is below the dew point set point by the dew point threshold, controlling the air driver to draw in vent air from the external environment and into the space within the building.

3. The method of claim 1, wherein determining the dew point of the conditioned air from the space within the building comprises:

moving the connecting member of the damper assembly to reposition the first damper in the closed position and the second damper in the open position;

controlling the air driver to draw air from the space within the building across a sensor; and measuring, via the sensor, the dew point of the air over a conditioned air sampling period.

4. The method of claim 1, wherein determining the dew point of the conditioned air from the space within the building comprises receiving the dew point of the conditioned air from the space within the building from a sensor disposed within the space within the building.

5. The method of claim 1, wherein determining the vent air dew point comprises receiving the vent air dew point from a sensor disposed in the external environment surrounding the building.

6. The method of claim 1, wherein determining the dew point of conditioned air from the space within the building comprises:

moving the connecting member to position the first damper in the closed position and the second damper in the open position, wherein the first damper is fluidly coupled to the vent exhaust opening that is fluidly coupled to the external environment surrounding the building, and wherein the second damper is fluidly coupled to the space within the building.

7. The method of claim 1, wherein determining the dew point set point comprises:

receiving, from a user interface, a relative humidity set point;

receiving indoor air temperature data from a temperature sensor disposed within the building; and calculating the dew point set point based on the relative humidity set point and the indoor air temperature data.

8. The method of claim 1, wherein determining the dew point of the conditioned air from the space within the building comprises controlling the air driver to draw air from the space within the building across a sensor positioned within the dehumidifier, and measuring, via the sensor, the dew point of the air over a conditioned air sampling period.

9. A control system, comprising:

a sensor configured to measure a dew point of air;

a dehumidifier assembly, including an air driver;

a damper assembly fluidly coupled to the dehumidifier assembly, the damper assembly comprising:

a first damper that controls an exchange of air with an external environment surrounding a building;

a second damper that controls a recirculation of conditioned air from a space within the building; and a connecting member coupled to both the first damper and the second damper and configured to move the first damper and the second damper; and a controller communicably coupled to the sensor, the dehumidifier assembly, and the damper assembly, the controller configured to:

receive a dew point set point;

determine a dew point of the conditioned air from the space within the building from the sensor;

in response to determining that the dew point satisfies the dew point set point, determine a vent air dew point of air in the external environment surrounding the building; and in response to determining that the vent air dew point is below the dew point set point by a dew point threshold:

controlling the connecting member to position the first damper in an open position to exhaust the conditioned air to a vent exhaust opening fluidly coupled to the external environment, and to position the second damper of the damper assembly in a closed position to substantially prevent recirculation of the conditioned air to the space within the building; and controlling the air driver to exhaust the conditioned air from the space to the external environment; and in response to determining that the vent air dew point satisfies the dew point set point or is within the dew point threshold of the dew point set point:

controlling the connecting member to position the first damper in the closed position to substantially prevent exhausting the conditioned air to the vent exhaust opening and positioning the second damper in the open position to recirculate the conditioned air to the space within the building; and activating the dehumidifier assembly to reduce a moisture level of the conditioned air within the space within the building.

10. The control system of claim 9, wherein the controller is further configured to:

in response to determining that the vent air dew point is below the dew point set point by the dew point threshold, control the air driver to draw in vent air from the external environment and into the space within the building.

11. The control system of claim 9, wherein the dehumidifier assembly includes a compressor, and wherein activating the dehumidifier assembly to reduce the moisture level of the conditioned air within the space within the building comprises activating the compressor.

12. The control system of claim 9, wherein determining the dew point from the sensor comprises:

moving the connecting member to reposition the first damper in the closed position and the second damper in the open position;

controlling the air driver to draw air from the space within the building across the sensor; and measuring, via the sensor, the dew point of the air over a conditioned air sampling period.

13. The control system of claim 9, further comprising a second sensor disposed in the external environment surrounding the building, wherein the controller is communicably coupled to the second sensor, and wherein determining the vent air dew point comprises receiving the vent air dew point from the second sensor.

14. The control system of claim 9, wherein determining the dew point of the conditioned air from the space within the building comprises controlling the air driver to draw air from the space within the building across a sensor positioned within the dehumidifier assembly, and measuring, via the sensor, the dew point of the air over a conditioned air sampling period.

15. An apparatus, comprising:

a humidity control unit comprising a memory storing machine readable instructions and a processor, the machine readable instructions configured to cause the processor to perform operations comprising:

determine a dew point set point;

determine a dew point of conditioned air from a space within a building wherein determining the dew point of the conditioned air comprises:

controlling an air driver to draw the conditioned air from the space within the building across a sensor; and measuring, via the sensor, the dew point of the conditioned air over a conditioned air sampling period;

in response to determining that the dew point satisfies the dew point set point, determine a vent air dew point of air in an external environment surrounding the building;

in response to determining that the vent air dew point is below the dew point set point by a dew point threshold:

control a connecting member of a damper assembly to position a first damper of the damper assembly in an open position to exhaust the conditioned air to a vent exhaust opening fluidly coupled to the external environment, and to position a second damper of the damper assembly in a closed position to substantially prevent recirculation of the conditioned air to the space within the building; and control the air driver of a dehumidifier to exhaust the conditioned air from the space to the external environment; and in response to determining that the vent air dew point satisfies the dew point set point or is within the dew point threshold of the dew point set point:

control the connecting member to position the first damper in the closed position to substantially prevent exhausting the conditioned air to the vent exhaust opening and positioning the second damper in the open position to recirculate the conditioned air to the space within the building; and activate a compressor of the dehumidifier to reduce a moisture level of the conditioned air within the space within the building.

16. The apparatus of claim 15, wherein determining the dew point of conditioned air from the space within the building comprises:

controlling the connecting member of the damper assembly to reposition the first damper in the closed position and the second damper in the open position;

controlling the air driver to draw air from the space within the building across a sensor; and measuring, via the sensor, the dew point of the air over the conditioned air sampling period.

17. The apparatus of claim 15, wherein determining the vent air dew point comprises receiving the vent air dew point from a sensor disposed in the external environment surrounding the building.

18. The apparatus of claim 15, wherein determining the dew point of the conditioned air from the space within the building comprises controlling the air driver to draw air from the space within the building across a sensor positioned within the dehumidifier, and measuring, via the sensor, the dew point of the air over the conditioned air sampling period.

* * * * *